US011035081B2

(12) United States Patent
Lindsay et al.

(10) Patent No.: US 11,035,081 B2
(45) **Date of Patent: *Jun. 15, 2021**

(54) RESILIENT HIGH BULK TISSUE PRODUCTS

(71) Applicant: Kimberly-Clark Worldwide, Inc., Neenah, WI (US)

(72) Inventors: Stephen Michael Lindsay, Appleton, WI (US); Michael Andrew Zawadzki, Appleton, WI (US); Cathleen Mae Uttecht, Menasha, WI (US); Mike Thomas Goulet, Neenah, WI (US); Kenneth John Zwick, Neenah, WI (US); Christopher Lee Satori, Hortonville, WI (US); Donald Eugene Waldroup, Roswell, GA (US)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 136 days.

This patent is subject to a terminal disclaimer.

(21) Appl. No.: 16/099,303

(22) PCT Filed: May 31, 2016

(86) PCT No.: PCT/US2016/035056
§ 371 (c)(1),
(2) Date: Nov. 6, 2018

(87) PCT Pub. No.: WO2017/209738
PCT Pub. Date: Dec. 7, 2017

(65) Prior Publication Data

US 2020/0240086 A1 Jul. 30, 2020

(51) Int. Cl.

| | |
|---|---|
| ***D21H 27/00*** | (2006.01) |
| ***D21H 11/04*** | (2006.01) |
| ***D21H 11/20*** | (2006.01) |
| ***D21F 9/00*** | (2006.01) |
| ***D21H 27/38*** | (2006.01) |

(52) U.S. Cl.
CPC ..... *D21H 27/007* (2013.01); *D21F 9/006* (2013.01); *D21H 11/04* (2013.01); *D21H 11/20* (2013.01); *D21H 27/38* (2013.01)

(58) Field of Classification Search
CPC ..... D21H 11/20; D21H 11/04; D21H 27/002; D21H 27/007; D21H 27/30; D21H 27/38; D21H 11/00; D21H 27/00; D21H 27/004; D21H 27/005; D21F 11/145; D21F 9/006; B32B 29/00; A47K 10/16
See application file for complete search history.

(56) References Cited

U.S. PATENT DOCUMENTS

| | | | | |
|---|---|---|---|---|
| 5,746,887 | A * | 5/1998 | Wendt | D21F 1/0027 162/109 |
| 6,187,137 | B1 | 2/2001 | Druecke et al. | |
| 6,328,850 | B1 | 12/2001 | Phan et al. | |
| 6,821,388 | B2 * | 11/2004 | Marsh | B32B 29/00 162/111 |
| 6,837,972 | B2 * | 1/2005 | Marsh | B32B 29/00 162/111 |
| 6,887,348 | B2 * | 5/2005 | Hermans | D21F 11/14 162/109 |
| 6,893,535 | B2 * | 5/2005 | Hermans | D21F 11/14 162/109 |
| 7,497,925 | B2 * | 3/2009 | Hermans | D21F 11/14 156/275.3 |
| 7,497,926 | B2 * | 3/2009 | Hermans | D21F 11/14 162/109 |
| 7,935,221 | B2 * | 5/2011 | Allen | D21F 5/182 162/116 |
| 8,753,751 | B1 | 6/2014 | Hermans et al. | |
| 10,487,454 | B2 * | 11/2019 | Lindsay | D21H 21/20 |
| 10,538,053 | B2 * | 1/2020 | Vogt | D21F 11/006 |
| 10,610,063 | B2 * | 4/2020 | Vogt | B32B 5/00 |
| 2003/0201083 | A1 * | 10/2003 | Marsh | D21F 11/145 162/146 |
| 2003/0203195 | A1 * | 10/2003 | Marsh | D21H 11/00 428/357 |
| 2003/0205342 | A1 * | 11/2003 | Jewell | D21H 11/20 162/9 |
| 2004/0101704 | A1 | 5/2004 | Hermans et al. | |
| 2004/0221975 | A1 | 11/2004 | Hernandez-Munoa et al. | |

(Continued)

FOREIGN PATENT DOCUMENTS

| | | |
|---|---|---|
| WO | 17209738 A1 | 12/2017 |
| WO | 17209739 A1 | 12/2017 |

(Continued)

*Primary Examiner* — Jose A Fortuna

(74) *Attorney, Agent, or Firm* — Kimberly-Clark Worldwide, Inc.

(57) ABSTRACT

The present invention provides tissue webs and products that are manufactured by non-compressive dewatering and/or drying methods, such as through-air drying, where the webs and products comprise cross-linked fiber. The non-compressively dewatered tissue webs and products have improved sheet bulk and z-direction properties. For example, in one embodiment, the invention provides through-air dried tissue products having good sheet bulk and resiliency, such as a sheet bulk greater than about 15 cc/g and Compression Energy (E) greater than about 1.30 N/m. Surprisingly the foregoing products have sufficient strength to withstand use, such as a GMT greater than about 600 g/3", but are not overly stiff, generally having a Stiffness Index less than about 12.

15 Claims, 2 Drawing Sheets

(56) References Cited

U.S. PATENT DOCUMENTS

| | | | | |
|---|---|---|---|---|
| 2005/0019563 | A1* | 1/2005 | Stoyanov | D21H 11/20 428/364 |
| 2005/0145350 | A1* | 7/2005 | Stoyanov | D21C 9/005 162/9 |
| 2005/0161178 | A1* | 7/2005 | Hermans | D21G 1/0066 162/109 |
| 2005/0161179 | A1* | 7/2005 | Hermans | D21F 11/145 162/109 |
| 2005/0217811 | A1* | 10/2005 | Stephens | D21H 11/20 162/9 |
| 2005/0217812 | A1 | 10/2005 | Stoyanov et al. | |
| 2007/0051484 | A1 | 3/2007 | Hermans et al. | |
| 2010/0051217 | A1* | 3/2010 | Allen | D21G 1/00 162/116 |
| 2010/0051218 | A1* | 3/2010 | Allen | D21F 11/14 162/116 |
| 2014/0096924 | A1 | 4/2014 | Rekoske et al. | |
| 2019/0136457 | A1* | 5/2019 | Lindsay | D21H 11/04 |
| 2019/0299562 | A1* | 10/2019 | Vogt | D21F 11/145 |
| 2020/0000295 | A1* | 1/2020 | Vogt | D21H 27/002 |
| 2020/0094513 | A1* | 3/2020 | Vogt | B32B 5/02 |
| 2020/0240086 | A1* | 7/2020 | Lindsay | D21H 27/007 |

FOREIGN PATENT DOCUMENTS

| | | | | |
|---|---|---|---|---|
| WO | WO-2017209739 | A1 * | 12/2017 | D21H 21/14 |
| WO | 18217599 | A1 | 11/2018 | |
| WO | 18217602 | A1 | 11/2018 | |

* cited by examiner

RESILIENT HIGH BULK TISSUE PRODUCTS

BACKGROUND OF THE DISCLOSURE

Today there is an ever increasing demand for soft, bulky tissue products, which also have sufficient tensile strength to withstand use. Traditionally the tissue maker has solved the problem of increasing sheet bulk without compromising strength and softness by adopting tissue making processes that only minimally compress the tissue web during manufacture, such as through-air drying. Although such techniques have improved sheet bulk, they have their limitations. For example, to obtain satisfactory softness the through-air dried tissue webs often need to be calendered, which may negate much of the bulk obtained by through-air drying.

Tissue product bulk may also be increased by treating a portion of the papermaking furnish with chemicals that facilitate the formation of covalent bonds between adjacent cellulose molecules. This process, commonly referred to as cross-linking, often involves the reaction of water soluble multi-functional molecules capable of reacting with cellulose under mildly acidic conditions. The cross-linking agents are generally methylol or alkoxymethyl derivatives of different N-containing compounds such as urea and cyclic ureas. Polycarboxylic acids and citric acid have also been used with varying degrees of success. Sheets formed from cross-linked cellulosic fibers, while having increased bulk, generally have poor tensile and tear strength, because of reduced fiber to fiber bonding.

To lessen the negative effects of cross-linked fibers the prior art has resorted to alternative cross-linking agents and to blending cross-linked and uncross-linked fibers together. For example, in U.S. Pat. No. 3,434,918 sheeted fiber is treated with a crosslinking agent and catalyst and wet aged to insolubilize the crosslinking agent. The fiber sheet is then dispersed and blended with non-cross-linked fibers to form a fiber slurry used to form a creped tissue web, which is subsequently passed under a dryer to cure the crosslinking-agent. In U.S. Pat. No. 3,455,778 bleached southern softwood kraft pulp is reacted with dimethylol urea to form cross-linked fibers, which are blended with untreated hardwood and softwood pulps. The blended pulps were used to form a creped tissue web having improved absorbent properties. In U.S. Pat. No. 4,204,054 wood pulp fibers were sprayed with a solution of formaldehyde, formic acid and hydrochloric acid and then immediately dispersed in a hot air stream for 1-20 seconds to form cross-linked fibers. The cross-linked fibers were then blended with uncross-linked fibers to form a sheet having improved flexibility and water absorbency. Finally, in U.S. Pat. No. 6,837,972 cross-linked cellulosic fibers are blended with softwood kraft pulps having an elevated hemicellulose content to form tissue webs. The tissue webs, while having increased bulk, have greatly diminished tensile strength.

Accordingly, what is needed in the art is a tissue product comprising cross-linked fibers that is both bulky and strong without any decrease in softness.

SUMMARY OF THE DISCLOSURE

It has now been surprisingly discovered that the sheet bulk of a cellulosic tissue web may be increased, with little or no degradation in tensile strength and without stiffening the web, by forming a non-compressively dewatered tissue web comprising cross-linked cellulosic fibers. The inventive tissue webs not only have improved sheet bulk, but the webs also have improved resiliency in the z-direction. The improved resiliency enables the tissue web to resist compression when calendered, preserving a high degree of bulk in the finished tissue product.

Accordingly, in one embodiment the present disclosure provides a non-compressively dewatered tissue product having a basis weight from about 20 to about 50 gsm, a sheet bulk of about 12 cc/g or greater and a Compression Energy (E) greater than about 1.30 N/m.

In other preferred embodiments the invention provides a non-compressively dewatered tissue product having a basis weight from about 20 to about 50 gsm, a GMT greater than about 600 g/3", and Stiffness Index less than about 12, such as from about 4 to about 12 and more preferably from about 4 to about 10, and a Compression Energy (E) greater than about 1.30 N/m.

In yet other embodiments, the invention provides a non-compressively dewatered tissue product having a basis weight from about 20 to about 50 gsm, a GMT greater than about 600 g/3", a sheet bulk greater than about 12 cc/g and a Vertical Absorbent Capacity greater than about 10 g/g.

In still other embodiments the present invention provides a single ply through-air dried tissue product comprising from about 5 to about 75 percent, and more preferably from about 20 to about 60 percent and still more preferably from about 20 to about 50 percent, by weight of the weight of the web, cross-linked fiber, wherein the product has a basis weight from about 20 to about 50 gsm, a GMT from about 600 to about 1,000 g/3", a sheet bulk greater than about 15 cc/g, such as from about 15 to about 25 cc/g and a Vertical Absorbent Capacity greater than about 10.0 and more preferably greater than about 12.0 g/g.

In other embodiments the present disclosure provides a two-ply tissue product comprising a first through-air dried multi-layered tissue web and a second through-air dried multi-layered tissue web that are plied together using well-known techniques. The through-air dried multi-layered webs comprise at least a first and a second layer, wherein cross-linked fibers are selectively incorporated in only one of the layers and the other layer is substantially free of cross-linked fibers. The foregoing two-ply tissue product comprises from about 5 to about 75 percent, and more preferably from about 20 to about 50 percent, by weight of the product, cross-linked fiber, wherein the product has a basis weight from about 20 to about 50 gsm, a GMT from about 600 to about 1,200 g/3", a sheet bulk greater than about 12 cc/g, such as from about 12 to about 20 cc/g and a Stiffness Index less than about 12.

Other features and aspects of the present invention are discussed in greater detail below.

DEFINITIONS

Figure 1A:
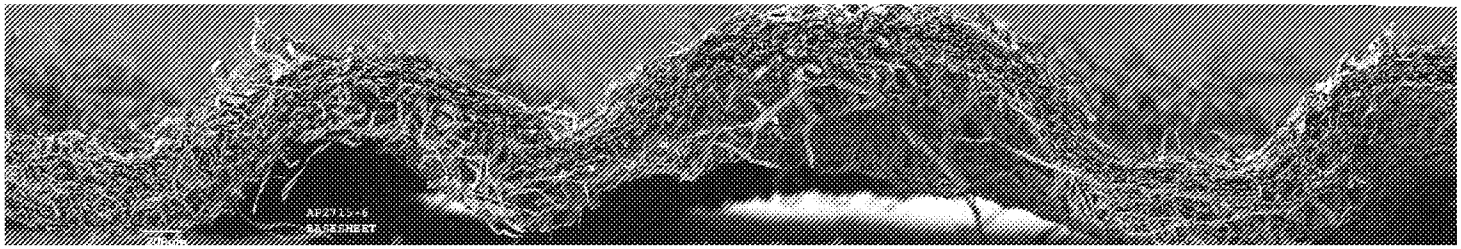
FIG. 1 is a cross-section scanning electron microscope (SEM) micrograph (Scale bar=200 μm) of a tissue basesheet prepared with cross-linked fibers (FIG. 1A) and a tissue basesheet prepared with cross-linked fibers (FIG. 1B)
Figure 1B:
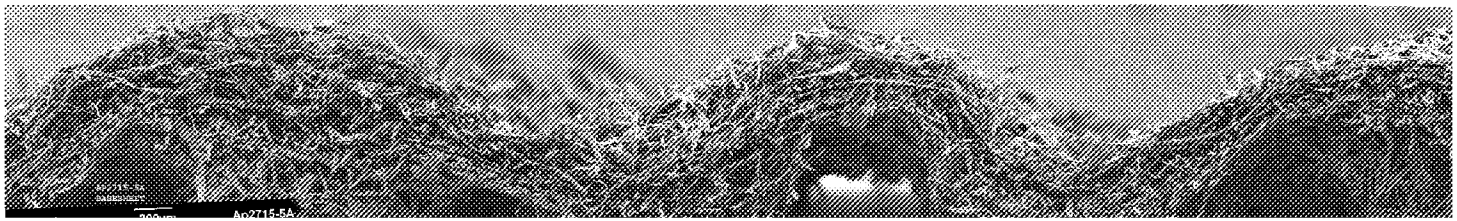
Figure 2A:
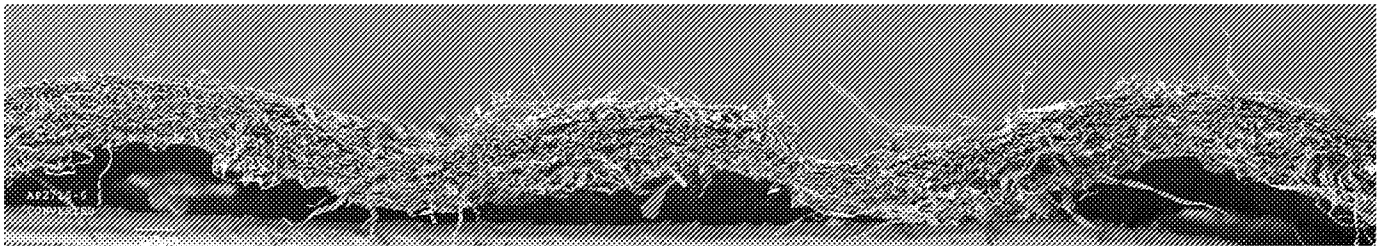
FIG. 2 is a cross-section scanning electron microscope (SEM) micrograph (Scale bar=200 μm) of a tissue product prepared with cross-linked fibers (FIG. 2A) and a tissue product prepared with cross-linked fibers (FIG. 2B). The illustrated tissue products were prepared by calendering the tissue basesheets illustrated in FIGS. 1A and 1B using a steel-on-rubber setup. The rubber roll used in the converting process had a hardness of 40 P&J and a load of 60 PLI was applied.
Figure 2B:
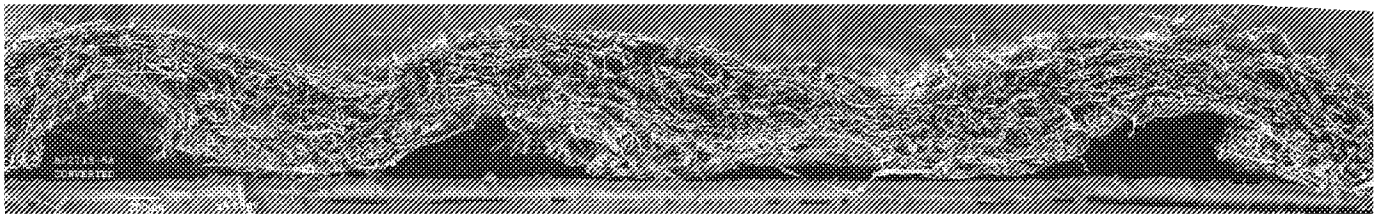

As used herein the terms "cross-linked fiber" refers to any cellulosic fibrous material reacted with a cross-linking agent.

As used herein, the term "tissue product" refers to products made from tissue webs and includes, bath tissues, facial tissues, paper towels, industrial wipers, foodservice wipers, napkins, medical pads, and other similar products. Tissue products may comprise one, two, three or more plies.

As used herein, the terms "tissue web" and "tissue sheet" refer to a fibrous sheet material suitable for forming a tissue product.

As used herein, the term "layer" refers to a plurality of strata of fibers, chemical treatments, or the like, within a ply.

As used herein, the terms "layered tissue web," "multi-layered tissue web," "multi-layered web," and "multi-layered paper sheet," generally refer to sheets of paper prepared from two or more layers of aqueous papermaking furnish which are preferably comprised of different fiber types. The layers are preferably formed from the deposition of separate streams of dilute fiber slurries, upon one or more endless foraminous screens. If the individual layers are initially formed on separate foraminous screens, the layers are subsequently combined (while wet) to form a layered composite web.

As used herein the term "ply" refers to a discrete product element. Individual plies may be arranged in juxtaposition to each other. The term may refer to a plurality of web-like components such as in a multi-ply facial tissue, bath tissue, paper towel, wipe, or napkin.

As used herein, the term "basis weight" generally refers to the bone dry weight per unit area of a tissue and is generally expressed as grams per square meter (gsm). Basis weight is measured using TAPPI test method T-220.

As used herein, the term "geometric mean tensile" (GMT) refers to the square root of the product of the machine direction tensile and the cross-machine direction tensile of the web, which are determined as described in the Test Method section.

As used herein, the term "caliper" is the representative thickness of a single sheet (caliper of tissue products comprising two or more plies is the thickness of a single sheet of tissue product comprising all plies) measured in accordance with TAPPI test method T402 using an EMVECO 200-A Microgage automated micrometer (EMVECO, Inc., Newberg, Oreg.). The micrometer has an anvil diameter of 2.22 inches (56.4 mm) and an anvil pressure of 132 grams per square inch (per 6.45 square centimeters) (2.0 kPa).

As used herein, the term "sheet bulk" refers to the quotient of the caliper (μm) divided by the bone dry basis weight (gsm). The resulting sheet bulk is expressed in cubic centimeters per gram (cc/g).

As used herein, the term "slope" refers to slope of the line resulting from plotting tensile versus stretch and is an output of the MTS TestWorks™ in the course of determining the tensile strength as described in the Test Methods section herein. Slope is reported in the units of grams (g) per unit of sample width (inches) and is measured as the gradient of the least-squares line fitted to the load-corrected strain points falling between a specimen-generated force of 70 to 157 grams (0.687 to 1.540 N) divided by the specimen width. Slopes are generally reported herein as having units of grams per 3 inch sample width or g/3".

As used herein, the term "geometric mean slope" (GM Slope) generally refers to the square root of the product of machine direction slope and cross-machine direction slope. GM Slope generally is expressed in units of kg/3" or g/3".

As used herein, the term "Stiffness Index" refers to the quotient of the geometric mean slope (having units of g/3") divided by the geometric mean tensile strength (having units of g/3").

As used herein the term "substantially free" refers to a layer of a tissue that has not been formed with the addition of cross-linked fiber. Nonetheless, a layer that is substantially free of cross-linked fiber may include de minimus amounts of cross-linked fiber that arise from the inclusion of cross-linked fibers in adjacent layers and do not substantially affect the softness or other physical characteristics of the tissue web.

As used herein, the term "through-air dried" generally refers to a method of manufacturing a tissue web where a drying medium, such as heated air, is blown through a perforated cylinder, the embryonic tissue web and the fabric supporting the web. Generally the embryonic tissue web is supported by the fabric and is not brought into contact with the perforated cylinder.

As used herein, "noncompressive dewatering" and "noncompressive drying" refer to dewatering or drying methods, respectively, for removing water from tissue webs that do not involve compressive nips or other steps causing significant densification or compression of a portion of the web during the drying or dewatering process. In particularly preferred embodiments the wet web is wet-molded in the process of noncompressive dewatering to improve the three-dimensionality and absorbent properties of the web.

As used herein, the term "Compression Energy" generally refers to the energy required to compress the sheet from its initial caliper at 0.29 psi to a lower caliper at a compressive load of 2.0 psi. Compression Energy (E) is calculated by integrating the compression curve from the initial height down to the compressed caliper as described in the Test Methods section below. Here, "Compression Energy" is calculated from the second compressive cycle. Compression Energy may have units of Newton-meter per square meter (N/m).

As used herein, the term "Exponential Compression Modulus" generally refers to the dry compression resiliency of the sheet. Exponential Compression Modulus (K) is found by least squares fitting of the caliper (C) and pressure data from a compression curve for a sample as described in the Test Methods section below.

As used herein, the term "Plastic Strain" generally refers to the permanent deformation in the tissue caused by compressing the material to a maximum load of 2.25 psi, according to the compression method described in the Test Methods section below. The initial caliper at 0.5 psi ($C_{initial}$) is compared to the caliper ($C_{final}$) at 0.5 psi after one compression cycle by the equation Plastic Strain=$\ln(C_{initial}/C_{final})$.

DETAILED DESCRIPTION OF THE DISCLOSURE

The present invention provides tissue webs and products that are manufactured by non-compressive dewatering and drying methods, such as through-air drying, where the webs and products comprise cross-linked fiber. The non-compressively dewatered tissue webs and products have improved sheet bulk and z-direction properties. For example, in one embodiment, the invention provides a non-compressive dewatered tissue web having a sheet bulk greater than about 15 cc/g, such as from about 15 to about 30 cc/g and more preferably from about 18 to about 25 cc/g. The foregoing tissue webs can be converted to tissue products without a significant loss of sheet bulk, while preserving a relatively high degree of tensile strength. For example, the tissue products generally preserve at least about 50 percent of the sheet bulk of the tissue web, such that the products have a sheet bulk greater than about 10 cc/g and more preferably greater than about 12 cc/g and still more preferably greater than about 15 cc/g and GMT greater than about 600 g/3", such as from about 600 to about 1,200 g/3" and more preferably from about 650 to about 1,000 g/3".

Surprisingly, the increase in bulk is achieved not only without a corresponding decrease in strength, but also without stiffening the web or product. As such, the present invention provides a through-air dried tissue products having a Stiffness Index less than about 12, such as from about 4 to about 12.

In addition to having improved bulk, good tensile strength and low stiffness, the instant webs and products also display favorable z-directional properties, such as high Compression Energy (E). For example, in one embodiment, the present invention provides a through-air dried tissue product having a compression energy of about 1.3 or more and more preferably about 1.4 or more, such as from about 1.4 to about 2.0 These properties are unique to non-compressively dewatered and/or dried products, such as through-air dried tissue products, and are not generally found in tissue products that have been compressed during manufacture, such as wet pressed tissue products.

To achieve the foregoing product properties the tissue webs and products of the present invention are generally prepared using cross-linked cellulosic fibers, which may comprise from about 5 to about 75 percent, preferably from about 10 to about 60 percent, more preferably from about 20 to about 50 percent, and still more preferably from about 30 to about 40 percent, of the dry weight of the web or product.

To form the inventive tissue webs and products cross-linked cellulosic fibers are combined with conventional non-cross-linked fibers to form a homogenous tissue web, or incorporated into one or more layers of a layered tissue web. The non-cross linked fibers may generally comprise any conventional papermaking fiber, which are well known in the art. For example, non-cross-linked fibers may comprise wood pulp fibers formed by a variety of pulping processes, such as kraft pulp, sulfite pulp, thermomechanical pulp, etc. Further, the wood pulp fibers may comprise high-average fiber length wood pulp fibers or low-average fiber length wood pulp fibers, as well as mixtures of the same. One example of suitable high-average length wood pulp fibers include softwood fibers such as, but not limited to, northern softwood, southern softwood, redwood, red cedar, hemlock, pine (e.g., southern pines), spruce (e.g., black spruce), combinations thereof, and the like. One example of suitable low-average length wood pulp fibers include hardwood fibers, such as, but not limited to, eucalyptus, maple, birch, aspen, and the like, which can also be used. Moreover, if desired, secondary fibers obtained from recycled materials may be used, such as fiber pulp from sources such as, for example, newsprint, reclaimed paperboard, and office waste.

The non-cross-linked fibers are generally combined with cross-linked fibers, such as by blending or layering, to produce the inventive tissue webs and products. In one embodiment the fibers are arranged in layers such that the tissue web has a first layer comprising cross-linked hardwood kraft fibers and a second layer comprising softwood kraft pulp fiber, where the second layer is substantially free of cross-linked fibers. In such embodiments the cross-linked fiber may be added to the first layer, such that the first layer comprises greater than about 2 percent, by weight of the layer, cross-linked fiber, such as from about 2 to about 40 percent and more preferably from about 5 to about 30 percent.

In other embodiments the cross-linked cellulosic fibers are selectively incorporated into a single layer of a three layered tissue web and more preferably the center layer of a three layer tissue web. For example, the cross-linked cellulosic fibers may comprise cross-linked-eucalyptus hardwood kraft pulp fibers (EHWK) which may be selectively incorporated in the middle layer of a three-layered tissue structure where the two outer layers comprise non-cross-linked cellulosic fibers, such as non-cross-linked Northern softwood kraft fiber (NSWK). In further embodiments it may be preferred that the two outer layers be substantially free from cross-linked-cellulosic fiber, such as cross-linked EHWK.

While the foregoing structures represent certain preferred embodiments it should be understood that the tissue product can include any number of plies or layers and can be made from various types of conventional unreacted cellulosic fibers and cross-linked fibers. For example, the tissue webs may be incorporated into tissue products that may be either single or multi-ply, where one or more of the plies may be formed by a multi-layered tissue web having cross-linked fibers selectively incorporated in one of its layers.

The cross-linked fibers useful in preparing the through-air dried tissue products and webs of the present invention may be prepared using a wide variety of cross-linking agents, which are well known in the art. For example, U.S. Pat. No. 5,399,240, the contents of which are incorporated herein in a manner consistent with the present invention, discloses cross-linking agents, such as polycarboxylic acids, for cross-linking cellulosic fibers, which may be useful in the present invention.

In certain embodiments the cross-linking agent may comprise a urea-based cross-linking agent. Suitable urea-based cross-linking agents include substituted ureas such as methylolated ureas, methylolated cyclic ureas, methylolated lower alkyl cyclic ureas, methylolated dihydroxy cyclic ureas, dihydroxy cyclic ureas, and lower alkyl substituted cyclic ureas. Specific urea-based cross-linking agents include dimethyldihydroxy urea (DMDHU, 1,3-dimethyl-4,5-dihydroxy-2-imidazolidinone), dimethylol dihydroxy ethylene urea (DMDHEU, 1,3-dihydroxymethyl-4,5-dihydroxy-2-imidazolidinone), dimethylol urea (DMU, bis[N-hydroxymethyl]urea), dihydroxyethylene urea (DHEU, 4,5-dihydroxy-2 imidazolidinone), dimethylolethylene urea (DMEU, 1,3-dihydroxymethyl-2-imidazolidinone), and dimethyldihydroxyethylene urea (DMeDHEU or DDI, 4,5-dihydroxy-1,3-dimethyl-2-imidazolidinone). A particularly preferred urea is dimethyldihydroxy urea (DMDHU, 1,3-dimethyl-4,5-dihydroxy-2 imidazolidinone.

In certain embodiments the aqueous solution may further comprise a catalyst for increasing the rate of bond formation between the cross-linking agent and the cellulose fibers. Preferred catalysts include, for example, metal salts such as inorganic acids, including magnesium chloride, aluminum chloride and zinc chloride.

In other embodiments the cross-linking agent may comprise a glyoxal adduct of urea such as that disclosed in U.S. Pat. No. 4,968,774, the contents of which are incorporated herein in a manner consistent with the present disclosure.

In still other embodiments the cross-linking agent may comprise a dialdehyde. Suitable dialdehydes include, for example, $C_2$-$C_8$ dialdehydes, $C_2$-$C_8$ dialdehyde acid analogs having at least one aldehyde group, and oligomers of these aldehyde and dialdehyde acid analogs, such as those described in U.S. Pat. No. 8,475,631, the contents of which are incorporated herein in a manner consistent with the present disclosure. A particularly preferred dialdehyde glyoxal is ethanedial.

In still other embodiments the cross-linking agent may comprise polymeric polycarboxylic acids such as those disclosed in U.S. Pat. Nos. 5,221,285 and 5,998,511, the contents of which are incorporated herein in a manner consistent with the present disclosure. Suitable polymeric polycarboxylic acid cross-linking agents include, for example, polyacrylic acid polymers, polymaleic acid polymers, copolymers of acrylic acid, copolymers of maleic acid, and mixtures thereof. Specific suitable polycarboxylic acid cross-linking agents include citric acid, tartaric acid, malic acid, succinic acid, glutaric acid, citraconic acid, itaconic acid, tartrate monosuccinic acid, maleic acid, polyacrylic acid, polymethacrylic acid, polymaleic acid, polymethylvinylether-co-maleate copolymer, polymethylvinylether-co-itaconate copolymer, copolymers of acrylic acid, and copolymers of maleic acid.

In certain embodiments the aqueous solution may further comprise a catalyst for increasing the rate of bond formation between the cross-linking agent and the cellulose fibers. Preferred catalysts include alkali metal salts of phosphorous containing acids such as alkali metal hypophosphites, alkali metal phosphites, alkali metal polyphosphonates, alkali metal phosphates, and alkali metal sulfonates.

Suitable methods of preparing cross-linked fibers include those disclosed in U.S. Pat. No. 5,399,240, the contents of which are incorporated by reference in a manner consistent with the present disclosure. The cross-linking agent is applied to the cellulosic fibers in an amount sufficient to effect intrafiber cross-linking. The amount applied to the cellulosic fibers can be from about 1 to about 10 percent by weight based on the total weight of fibers. In one embodiment, the cross-linking agent is applied in an amount from about 4 to about 6 percent by weight based on the total weight of fibers.

In one embodiment cross-linked fibers may be prepared by first forming a mat of fiber, such as EHWK, and saturating the mat with an aqueous solution comprising a cross-linking agent selected from the group consisting of DMDHU, DMDHEU, DMU, DHEU, DMEU, and DMeDHEU. The pulp mat, after saturation with the solution, may be pressed to partially dry the mat and then further dried, such as by air drying, to produce a treated sheet. The treated sheet is then defibered in a hammermill to form a fluff consisting essentially of individual fibers, which are then heated to between 300° F. and 340° F. to cure the fiber and effect cross-linking.

Generally the cross-linked fiber is not subject to further modification after formation. For example, the cross-linked fiber is generally not reacted with a chemical debonder to further inhibit hydrogen bonding between fibers. Chemical debonder agents are well known in the art and may comprise fatty chain quaternary ammonium salts. Similarly, the cross-linked fiber is generally not reacted with a wet strength agent to form covalent bonds between the cross-linked fibers and improve tensile strength properties when the resulting webs and products are wetted. Wet strength agents, both permanent and temporary, are well known in the art and may comprise water soluble, cationic oligomeric or polymeric resins. Examples of permanent wet strength agents include polyamine-epichlorohydrin, polyamide epichlorohydrin or polyimide-amine epichlorohydrin resins, collectively termed "RAE resins." Examples of temporary wet strength agents include glyoxalated polyacrylamide resins, dialdehyde starch, polyethylene imine, mannogalactan gum, glyoxal, and dialdehyde mannogalactan.

While the cross-linked fibers are generally not subject to further modification after formation, other non-cross-linked fibers used in the formation of the inventive tissue products may be reacted with chemical debonders, cationic wet strength agents and the like. Thus, prior to formation of the wet tissue web, the non-cross-linked fiber may be reacted with a debonder, a permanent wet strength agent or a temporary wet strength agent. For example, a the non-cross-linked fiber may be dispersed in water to form an aqueous slurry of non-cross-linked fiber to which an effective amount of a debonder, a permanent wet strength agent or a temporary wet strength agent, or combinations thereof, may be added to yield a treated non-cross-linked fiber slurry. The treated non-cross-linked fiber slurry may then be disposed on a foraminous surface along with a cross-linked fiber slurry to form an embryonic web.

Compared to similar tissue products prepared without cross-linked fibers, tissue products prepared according to the present disclosure are generally of comparable stiffness (measured as Stiffness Index) and strength (measured as GMT) yet have significantly higher sheet bulk. This effect is illustrated in the table below, which compares two similarly prepared single ply tissue with and without cross-linked fibers.

TABLE 1

| Sample | Sheet Bulk (cc/g) | GMT (g/3") | GM Slope (kg/3") | Stiffness Index |
|---|---|---|---|---|
| Conventional | 10.8 | 647 | 7.15 | 11.1 |
| Inventive | 15.0 | 645 | 7.55 | 11.7 |

Unexpectedly the increase in bulk without a corresponding decrease in strength is most acute when the webs are through-air dried. The table below compares comparable tissue products, prepared with and without cross-linked pulp fibers, manufactured by conventional creped wet pressed methods and by through-air drying according to the present invention. The change in bulk and strength (GMT) indicated below reflect the difference between similar tissue products prepared with and without cross-linked fibers. For example, tissue products comprising cross-linked fibers prepared according to the present invention had similar strength, but much higher bulk, compared to similar tissue products that did not contain cross-linked fiber.

TABLE 2

| Sample | Manufacture | Cross-linked Fiber (wt %) | Basis Wt. (gsm) | Delta Sheet Bulk (%) | Delta GMT (%) |
|---|---|---|---|---|---|
| US 6837972 | Creped wet pressed | 13.5 | 23 | 7.6 | −10 |
| US 6837972 | Creped wet pressed | 17.2 | 23 | 12 | −14 |
| PCT/US15/18009 | Creped wet pressed | 30.0 | 30 | 17 | −0.3 |
| PCT/US15/18009 | Creped wet pressed | 60.0 | 30 | 47 | −21 |
| Inventive | Through-air Dried | 50.0 | 36 | 39 | 0 |

Thus, in certain embodiments the present invention provides a non-compressively dewatered tissue product comprising from about 5 to about 50 percent, and more preferably from about 10 to about 30 percent, by weight of the weight of the web, cross-linked fiber, wherein the product has a basis weight from about 20 to about 50 gsm, a GMT from about 600 to about 800 g/3", a sheet bulk greater than about 12 cc/g, such as from about 12 to about 20 cc/g and Stiffness Index less than about 12.

In certain instances the foregoing benefits, such as increased sheet bulk without a decrease in strength, may even be obtained when the long fiber fraction of the fiber furnish is substituted with cross-linked fibers. For example, it has been discovered that cross-linked fibers may be substituted for non-cross-linked softwood kraft fibers without deleterious effects despite their inability to participate in hydrogen bonding. Thus, in certain preferred embodiments, the present invention provides a single ply tissue product comprising a layered tissue web having two outer layers and a middle layer where cross-linked hardwood pulp fibers are selectively disposed in the middle layer and the middle layer is substantially free from non-cross-linked softwood kraft fibers, wherein the tissue product has a basis weight from about 30 to about 50 gsm, a GMT greater than about 600 g/3" and a sheet bulk greater than about 12 cc/g.

In other embodiments the present disclosure provides a multilayered tissue web comprising cross-linked fibers selectively disposed in one or more layers, wherein the tissue layer comprising cross-linked fibers is adjacent to a layer comprising non cross-linked fiber and which is substantially free from non-cross-linked fiber. In a particularly preferred embodiment the web comprises three layers where cross-linked fibers are disposed in the middle layer and the first and third layers are substantially free from cross-linked fibers.

In those embodiments where the tissue web comprises three layers and the cross-linked fibers selectively disposed in the middle layer, the middle layer may be weaker than the two outer layers. Despite having a relatively weak middle layer, the tensile strengths of such tissue webs are not significantly reduced. As such, in certain embodiments, the present invention provides a tissue product comprising a tissue web having three layers where the middle layer comprises cross-linked cellulosic fibers and two outer layers are substantially free from cross-linked cellulosic fibers, the product having a GMT greater than about 600 g/3" and more preferably greater than about 700 g/3", such as from about 600 to about 1,000 g/3". Further, the foregoing tissue products generally have improved sheet bulk, such as a sheet bulk greater than about 12 cc/g.

Tissue webs of the present disclosure can generally be formed by a variety of papermaking processes using non-compressive dewatering and/or drying known in the art. Preferably the tissue web is formed by through-air drying and may be either creped or uncreped. For example, a papermaking process of the present disclosure can utilize adhesive creping, wet creping, double creping, embossing, wet-pressing, air pressing, through-air drying, creped through-air drying, uncreped through-air drying, as well as other steps in forming the paper web. Some examples of such techniques are disclosed in U.S. Pat. Nos. 5,048,589, 5,399,412, 5,129,988 and 5,494,554, all of which are incorporated herein in a manner consistent with the present disclosure. When forming multi-ply tissue products, the separate plies can be made from the same process or from different processes as desired.

The basis weight of tissue webs made in accordance with the present disclosure can vary depending upon the final product. For example, the process may be used to produce bath tissues, facial tissues, and the like. In general, the basis weight of the tissue web may vary from about 10 to about 50 gsm and more preferably from about 25 to about 45 gsm. Tissue webs may be converted into single and multi-ply bath or facial tissue products having basis weight from about 20 to about 50 gsm and more preferably from about 25 to about 45 gsm.

In certain embodiments tissue webs produced according to the present invention may be subjected to additional processing after formation such as calendering in order to convert them into tissue products. The tissue webs of the present invention are surprisingly resilient and retain a high degree of bulk compared to similar webs prepared without cross-linked fibers. The increased resiliency allows the webs to be calendered to produce a soft tissue product without a significant decrease in bulk. A comparison of various tissue webs illustrating this effect are shown in the table below.

TABLE 3

| Sample | Cross-linked Fiber (wt %) | Calender Load (pli) | Initial Sheet Bulk (cc/g) | Finished Sheet Bulk (cc/g) | Delta Sheet Bulk (%) | Plastic Strain @ 0.5 psi (%) |
|---|---|---|---|---|---|---|
| Conventional | — | 60 | 25.6 | 10.8 | −58 | 5.97 |
| Inventive | 50 | 60 | 24.7 | 15.0 | −39 | 3.53 |

According, in certain embodiments the present invention provides a tissue product having a basis weight from about 20 to about 50 gsm, and more preferably from about 25 to about 45 gsm, GMT from about 600 to about 800 g/3", a sheet bulk greater than about 12 cc/g, such as from about 12 to about 20 cc/g and a Plastic Strain less than about 5.0 percent, such as from about 2.0 to about 5.0 percent and more preferably from about 2.0 to about 4.0.

Not only are the webs resilient, but in certain embodiments they may be relatively supple and readily compressible. As such, the inventive webs and products may have a Compression Energy (E) greater than about 1.3 N/m, such as from about 1.4 N/m to about 2.0 N/m. Despite having a relatively high Compression Energy (E), the instant webs and products retain a high degree of their sheet bulk when processed, as such, in certain embodiments the invention provides a non-compressively dewatered tissue product having a sheet bulk of about 12 cc/g or greater and Compression Energy (E) of about greater than about 1.30, such as from about 1.30 to about 2.00 and more preferably from about 1.40 to about 2.00.

In other embodiments the present invention provides a tissue product having a basis weight from about 20 to about 50 gsm, and more preferably from about 25 to about 45 gsm, GMT from about 600 to about 800 g/3", a sheet bulk greater than about 12 cc/g, such as from about 12 to about 20 cc/g, a Compression Energy (E) greater than about 1.30, such as from about 1.30 to about 2.00 and more preferably from about 1.40 to about 2.00. In certain embodiments the foregoing tissue products may have and an Exponential Compression Modulus (K) less than about 6.50, such as from about 4.00 to about 6.00.

Further, in certain preferred embodiments, the improvement in z-direction properties does not come at the expense of x-y direction properties, such as sheet stiffness (measured as Stiffness Index). Thus, the invention provides a tissue product having improved z-direction properties, such as a Compression Energy of about 1.3 or greater and relatively low stiffness, such as a Stiffness Index of about 12 or less. For example, in one preferred embodiment, the invention provides a non-compressively dewatered tissue product having a basis weight from about 20 to about 50 gsm, a GMT greater than about 600 g/3", and Stiffness Index less than about 12, such as from about 4 to about 12 and more preferably from about 4 to about 10, and a Compression Energy of 1.30 N/m or greater.

In addition to having improved z-directional properties, the inventive tissue webs and products may also have improved absorbency (measured as Vertical Absorbent Capacity). As such the Vertical Absorbent Capacity of the sheets of this invention may be greater than about 10 g/g, and more preferably greater than about 12 g/g, such as from about 10 to about 14 g/g. For example, in certain embodiments, the invention provides a non-compressively dewatered tissue product having a basis weight from about 20 to about 50 gsm, a GMT greater than about 600 g/3", a sheet bulk greater than about 12 cc/g and a Vertical Absorbent Capacity greater than about 10 g/g.

In a particularly preferred embodiment the present disclosure provides a single ply through-air dried tissue product comprising from about 5 to about 50 percent, and more preferably from about 10 to about 30 percent, by weight of the weight of the web, cross-linked fiber, wherein the product has a basis weight from about 20 to about 50 gsm, a GMT from about 600 to about 800 g/3", a sheet bulk greater than about 12 cc/g, such as from about 12 to about 20 cc/g and a Vertical Absorbent Capacity greater than about 10.0 and more preferably greater than about 12.0 g/g.

In other embodiments the present disclosure provides a two-ply tissue product comprising a first through-air dried multi-layered tissue web and a second through-air dried multi-layered tissue web that are plied together using well-known techniques. The through-air dried multi-layered webs comprise at least a first and a second layer, wherein cross-linked fibers are selectively incorporated in only one of the layers and the other layer is substantially free of cross-linked fibers. The foregoing two-ply tissue product comprises from about 5 to about 75 percent, and more preferably from about 20 to about 50 percent, by weight of the product, cross-linked fiber, wherein the product has a basis weight from about 20 to about 50 gsm, a GMT from about 600 to about 1,200 g/3", a sheet bulk greater than about 12 cc/g, such as from about 12 to about 20 cc/g and a Stiffness Index less than about 12, such as from about 4 to about 12.

Test Methods

Sheet Bulk

Sheet Bulk is calculated as the quotient of the dry sheet caliper (μm) divided by the basis weight (gsm). Dry sheet caliper is the measurement of the thickness of a single tissue sheet measured in accordance with TAPPI test methods T402 and T411 om-89. The micrometer used for carrying out T411 om-89 is an Emveco 200-A Tissue Caliper Tester (Emveco, Inc., Newberg, Oreg.). The micrometer has a load of 2 kilo-Pascals, a pressure foot area of 2500 square millimeters, a pressure foot diameter of 56.42 millimeters, a dwell time of 3 seconds and a lowering rate of 0.8 millimeters per second.

Tensile

Tensile testing was done in accordance with TAPPI test method T-576 "Tensile properties of towel and tissue products (using constant rate of elongation)" wherein the testing is conducted on a tensile testing machine maintaining a constant rate of elongation and the width of each specimen tested is 3 inches. More specifically, samples for dry tensile strength testing were prepared by cutting a 3 inches±0.05 inches (76.2 mm±1.3 mm) wide strip in either the machine direction (MD) or cross-machine direction (CD) orientation using a JDC Precision Sample Cutter (Thwing-Albert Instrument Company, Philadelphia, Pa., Model No. JDC 3-10, Serial No. 37333) or equivalent. The instrument used for measuring tensile strengths was an MTS Systems Sintech 11S, Serial No. 6233. The data acquisition software was an MTS TestWorks® for Windows Ver. 3.10 (MTS Systems Corp., Research Triangle Park, N.C.). The load cell was selected from either a 50 Newton or 100 Newton maximum, depending on the strength of the sample being tested, such that the majority of peak load values fall between 10 to 90 percent of the load cell's full scale value. The gauge length between jaws was 4±0.04 inches (101.6±1 mm) for facial tissue and towels and 2±0.02 inches (50.8±0.5 mm) for bath tissue. The crosshead speed was 10±0.4 inches/min (254±1 mm/min), and the break sensitivity was set at 65 percent. The sample was placed in the jaws of the instrument, centered both vertically and horizontally. The test was then started and ended when the specimen broke. The peak load was recorded as either the "MD tensile strength" or the "CD tensile strength" of the specimen depending on direction of the sample being tested. Ten representative specimens were tested for each product or sheet and the arithmetic average of all individual specimen tests was recorded as the appropriate MD or CD tensile strength the product or sheet in units of grams of force per 3 inches of sample. The geometric mean tensile (GMT) strength was calculated and is expressed as grams-force per 3 inches of sample width. Tensile energy absorbed (TEA) and slope are also calculated by the tensile tester. TEA is reported in units of gm cm/cm$^2$. Slope is recorded in units of kg. Both TEA and Slope are directionally dependent and thus MD and CD directions are measured independently. Geometric mean TEA and geometric mean slope are defined as the square root of the product of the representative MD and CD values for the given property.

Compression Energy

Generally Compression Energy (E) refers to the energy required to compress the sheet from its initial basesheet caliper down to its final finished product caliper. Compression Energy is calculated by integrating the compression curve from the zero load height down to the finished product caliper as:

$$E=\int_{C_{fp}}^{\infty} P dC$$

where P is the pressure at any given caliper (C) and is defined as:

$$P = P_0\left(\frac{C_0}{C}\right)^K$$

where:

"P" is the pressure (MPa);

"$P_0$" is a reference pressure equal to 0.002 MPa;

"C" is the product caliper under the pressure P (mm);

"$C_0$" is the initial caliper under the 0.002 MPa reference pressure (mm); and

"K" is the finished product exponential compression modulus.

The "exponential compression modulus" (K) is found by least squares fitting of the caliper (C) and pressure data from a compression curve for the sample. The compression curve is measured by compressing a stack of sheets between parallel plates on a suitable tensile frame (for example the MTS Systems Sintech 11S from MTS® Corporation). The upper platen is to be 57 mm in diameter and the lower platen 89 mm in diameter. The stack of sheets should contain 10 sheets (102 mm by 102 mm square) stacked with their machine direction and cross-machine directions aligned. The sample stack should be placed between the platens with a known separation of greater than the unloaded stack height. The platens should then be brought together at a rate of 12.7 mm/minute while the force is recorded with a suitable load cell (say 100 N Self ID load cell from MTS® Corporation). The force data should be acquired and saved at 100 hz. The compression should continue until the load exceeds 44.5 Newtons, at which point the platen should reverse direction and travel up at a rate of 12.7 mm/minute until the force decreases below 0.18 Newtons. The platen should then reverse direction again and begin a second compression cycle at a rate of 12.7 mm/minute until a load of 44.5 Newtons is exceeded. The load data should then be converted to pressure data by dividing by the 2552 $mm^2$ contact area of the platens to give pressures in $N/mm^2$ or MPa. The pressure versus stack height data for the second compression cycle between the pressures of 0.07 kPa and 17.44 kPa is then least squares fit to the above expression after taking the logarithm of both sides to obtain:

$$\ln(P)=a-K\ln(C)$$

where "a" is a constant. The slope from the least squares fit is the exponential compression modulus (K). Five samples are to be tested per code and the average value of "K" reported.

By integrating the compression curve above, the Compression Energy "E" required to compress the sheet to any final caliper "C" is thus defined as follows:

$$E=\int_C^{\infty} PdC=\frac{P_0C_0^K}{(K-1)C^{K-1}}$$

where "K" is the exponential compression modulus from the finished product test described above, C is the final, compressed, caliper, and $C_0$ is the initial, uncompressed, caliper.

EXAMPLES

Single ply uncreped through-air dried (UCTAD) tissue webs were made generally in accordance with U.S. Pat. No. 5,607,551. The tissue webs and resulting tissue products were formed from various fiber furnishes including, eucalyptus hardwood kraft (EHWK), cross-linked EHWK (XL-EHWK) and Northern softwood kraft (NSWK).

Cross-linked fibers were prepared by first dispersing eucalyptus hardwood kraft (EHWK) in a pulper for approximately 30 minutes at a consistency of about 10 percent. The pulp was then pumped to a machine chest and diluted to a consistency of about 2 percent and then pumped to a headbox and further diluted to a consistency of about 1 percent. From the headbox, the fibers were deposited onto a felt using a Fourdrinier former. The fiber web was pressed and dried to form a fiber web having a consistency of about 90 percent and a bone dry basis weight from about 500 to 700 gsm. The fiber web was treated with a 25 percent solids solution of DMDHEU (commercially available from Omnova Solutions, Inc. under the trade name Permafresh®CSI-2) using a flooded-nip horizontal size press. In certain instances 0.01 percent by weight CMC (commercially available from CP Kelco under the trade name Finnfix®300 CMC) was added to the DMDHEU solution to adjust solution viscosity. The sheet was saturated in the flooded nip and squeezed to evenly distribute the cross-linker solution. After the size press, the sheet was dried (approximately 220° F.) to around 92 percent consistency and rolled on a reel. The treated pulp was mechanically separated in a hammermill using a screen with 3 mm holes. Separated fibers were pneumatically conveyed to an air-forming head where they were laid onto a carrier tissue at a basis weight of around 200 to 400 gsm. The airlaid fiber mat was continuously conveyed through a through-air dryer at about 170° F. The fiber mat was conveyed at a rate of around 1.8 to 2.5 m/min, for a total residence time from about 5 to about 7 minutes. The resulting cross-linked eucalyptus hardwood kraft fibers (XL-EWHK) were collected and used to prepare tissue webs as described below.

Northern softwood kraft (NSWK) furnish was prepared by dispersing NSWK pulp in a pulper for 30 minutes at about 2 percent consistency at about 100° F. The NSWK pulp was then transferred to a dump chest and subsequently diluted with water to approximately 0.2 percent consistency. Softwood fibers were then pumped to a machine chest. In certain instances, starch was added to the machine chest, as indicated in the table below. Also, in certain instances, NSWK pulp was refined as set forth in the table below.

Eucalyptus hardwood kraft (EHWK) furnish was prepared by dispersing EWHK pulp in a pulper for 30 minutes at about 2 percent consistency at about 100° F. The EHWK pulp was then transferred to a dump chest and diluted to about 0.2 percent consistency. The EHWK pulp was then pumped to a machine chest.

Cross-linked EHWK (XL-EWHK), prepared as described above, was dispersed in a pulper for 30 minutes at about 1 percent consistency at about 100° F. The XL-EWHK was then transferred to a dump chest and diluted to about 0.2 percent consistency. The XL-EWHK was then pumped to a machine chest.

TABLE 4

| Sample | Refining (min) | Starch (kg/MT) | XL-EHWK (wt %) | First Layer (wt %) | Center Layer (wt %) | Third Layer (wt %) |
|---|---|---|---|---|---|---|
| 1 | — | — | — | NSWK (25%) | EHWK (50%) | NSWK (25%) |
| 2 | 11 | 1.25 | 50% | NSWK (25%) | XL-EHWK (50%) | NSWK (25%) |

The stock solutions were pumped to a 3-layer headbox to form a three layered tissue web. NSWK fibers were disposed on the two outer layers and EHWK (EHWK or XL-EHWK)

were disposed in the middle layer. The relative weight percentage of the layers was 25%-50%-25%. The target basis weight for all codes was 36 gsm (as-is basis weight). The formed web was non-compressively dewatered and rush transferred to a transfer fabric traveling at a speed about 24 percent slower than the forming fabric. The transfer vacuum at the transfer to the TAD fabric was maintained at approximately 6 inches of mercury vacuum to control molding to a constant level. The web was then transferred to a throughdrying fabric, dried and wound into a parent roll. The parent rolls were then converted into 1-ply bath tissue rolls. Calendering was done with a steel-on-rubber setup. The rubber roll used in the converting process had a hardness of 40 P&J and a load of 60 PLI. The rolls were converted to a diameter of about 117 mm. Samples were conditioned and tested, the results of which are summarized in the tables below. The finished tissue product properties are summarized in Table 6 and 7.

TABLE 5

| Sample | Basesheet Caliper (um) | Product Caliper (um) | Delta Caliper (%) | Basesheet Sheet Bulk (cc/g) | Product Sheet Bulk (cc/g) | Delta Sheet Bulk (%) |
|---|---|---|---|---|---|---|
| 1 | 921 | 376 | −59 | 25.6 | 10.8 | −58 |
| 2 | 888 | 518 | −42 | 24.7 | 15.0 | −39 |

TABLE6

| Sample | GMT (0/3") | MD Stretch (%) | CD Stretch (%) | GM Slope (kg) | Stiffness Index | Absorbent Capacity (g/g) |
|---|---|---|---|---|---|---|
| 1 | 645 | 11.3 | 7.3 | 7.15 | 11.1 | 8.5 |
| 2 | 647 | 12.5 | 7.7 | 7.55 | 11.7 | 12.9 |

TABLE 7

| Sample | Basesheet K | Basesheet E (N/m) | Basesheet Plastic Strain @ 0.5 psi (%) | Product K | Product E (N/m) | Product Plastic Strain @ 0.5 psi (%) |
|---|---|---|---|---|---|---|
| 1 | 5.33 | 1.89 | 21.63 | 6.37 | 1.11 | 3.53 |
| 2 | 5.69 | 2.14 | 13.95 | 5.76 | 1.50 | 5.97 |

While tissue webs, and tissue products comprising the same, have been described in detail with respect to the specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto and the foregoing embodiments:

In a first embodiment the present invention provides a tissue product comprising a non-compressively dewatered web, the product having a basis weight from about 20 to about 50 gsm, a sheet bulk of about 12 cc/g or greater and an Compression Energy (E) greater than about 1.30 N/m.

In a second embodiment the present invention provides the non-compressively dewatered tissue product of the first embodiment having an Exponential Compression Modulus (K) less than about 6.50.

In a third embodiment the present invention provides the non-compressively dewatered tissue product of the first or the second embodiments wherein the product has a Plastic Strain from about 2.0 to about 5.0 percent.

In a fourth embodiment the present invention provides the non-compressively dewatered tissue product of any one of the first through the third embodiments wherein the product has a GMT from about 600 to about 800 g/3" and a Stiffness Index less than about 12.

In a fifth embodiment the present invention provides the non-compressively dewatered tissue product of any one of the first through the fourth embodiments wherein the product has a Vertical Absorbent Capacity greater than about 10 g/g.

In a sixth embodiment the present invention provides the non-compressively dewatered tissue product of any one of the first through the fifth embodiments wherein the tissue web comprises from about 30 to about 75 percent, by weight of the product, cross-linked cellulosic fibers.

In a seventh embodiment the present invention provides the non-compressively dewatered tissue product of any one of the first through the sixth embodiments wherein the tissue web comprises from about 30 to about 75 percent, by weight of the product, eucalyptus hardwood kraft fibers reacted with a cross-linking reagent selected from the group consisting of 1,3-dimethyl-4,5-dihydroxy-2-imidazolidinone (DMDHU), 1,3-dihydroxymethyl-4,5-dihydroxy-2-imidazolidinone (DMDHEU), bis[N-hydroxymethyl]urea (DMU), 4,5-dihydroxy-2-imidazolidinone (DHEU), 1,3-dihydroxymethyl-2-imidazolidinone (DMEU) and 4,5-dihydroxy-1,3-dimethyl-2-imidazolidinone (DMeDHEU).

In an eighth embodiment the present invention provides the non-compressively dewatered tissue product of any one of the first through the seventh embodiments wherein the tissue web comprises a first fibrous layer comprising from about 30 to about 75 percent, by weight of the product, cross-linked cellulosic fibers and a second fibrous layer that is substantially free from cross-linked cellulosic fibers.

In a ninth embodiment the present invention provides a method of forming a resilient high bulk tissue product comprising the steps of: (a) dispersing a cross-linked hardwood pulp fiber in water to form a first fiber slurry; (b) dispersing uncross-linked conventional wood pulp fibers in water to form a second fiber slurry; (c) depositing the first and the second fiber slurries in a layered arrangement on a moving belt to form a tissue web; (d) non-compressively drying the tissue web to a yield a dried tissue web having a consistency from about 80 to about 99 percent solids; and (e) calendering the dried tissue web to yield a resilient high bulk tissue product.

In a tenth embodiment the present invention provides the method of the ninth embodiment wherein the resulting tissue product has a basis weight from about 20 to about 50 gsm, a sheet bulk of about 12 cc/g or greater and a Compression Energy (E) greater than about 1.30 N/m.

In an eleventh embodiment the present invention the method of any one of the ninth or tenth embodiments wherein the cross-linked hardwood pulp fiber comprises eucalyptus hardwood kraft pulp fibers reacted with a cross-linking agent selected from the group consisting of DMDHU, DMDHEU, DMU, DHEU, DMEU, and DMeDHEU.

In a twelfth embodiment the present invention provides the method of any one of the ninth through eleventh embodiments wherein the tissue product comprises from about 5 to about 75 percent cross-linked hardwood pulp fiber and from about 95 to about 25 percent uncross-linked NSWK fibers.

In a thirteenth embodiment the present invention provides the method of any one of the ninth through twelfth embodiments wherein the step of calendering comprises passing the web through a nip having a load of at least about 50 pli, wherein the step of calendering reduces the sheet bulk from about 30 to about 50 percent.

In a fourteenth embodiment the present invention provides the method of any one of the ninth through thirteenth embodiments wherein the dried tissue web has a sheet bulk greater than about 15 cc/g and the resilient high bulk tissue product has a sheet bulk greater than about 12 cc/g.

What is claimed is:

1. A tissue product comprising at least one non-compressively dewatered tissue web comprising from about 10 to about 50 percent, by weight of the web, cross-linked cellulosic fibers, the product having a basis weight from about 20 to about 50 gsm, a sheet bulk of about 12 cc/g or greater and a Compression Energy (E) greater than about 1.30 N/m.

2. The tissue product of claim 1 wherein the product has a geometric mean tensile strength (GMT) from about 600 to about 1,000 g/3" and an Exponential Compression Modulus (K) less than about 6.50.

3. The tissue product of claim 1 wherein the product has a Vertical Absorbent Capacity greater than about 10 g/g.

4. The tissue product of claim 1 wherein the product has an Exponential Compression Modulus (K) from about 4.0 to about 6.0 and the Compression Energy (E) is from about 1.30 to about 2.00 N/m.

5. The tissue product of claim 1 wherein the product consists essentially of a single non-compressively dewatered tissue web, the product having a basis weight from about 30 to about 45 gsm and a Vertical Absorbent Capacity from about 10 to about 15 g/g.

6. The tissue product of claim 5 having a GMT from about 600 to about 1,000 g/3" and a Stiffness Index from about 4 to about 10.

7. The tissue product of claim 1 wherein the cross-linked cellulosic fibers comprise hardwood kraft fibers reacted with a cross-linking reagent selected from the group consisting of 1,3-dimethyl-4,5-dihydroxy-2-imidazolidinone (DMDHU), 1,3-dihydroxymethyl-4,5-dihydroxy-2-imidazolidinone (DMDHEU), bis[N-hydroxymethyl]urea (DMU), 4,5-dihydroxy-2-imidazolidinone (DHEU), 1,3-dihydroxymethyl-2-imidazolidinone (DMEU) and 4,5-dihydroxy-1,3-dimethyl-2-imidazolidinone (DMeDHEU).

8. The tissue product of claim 1 wherein the tissue web comprises a first fibrous layer comprising cross-linked cellulosic fibers and a second fibrous layer that is substantially free from cross-linked cellulosic fibers.

9. A single ply through-air dried tissue product comprising at least about 10 percent, by weight of the product, cross-linked cellulosic fibers, the product having a basis weight from about 20 to about 50 gsm, a sheet bulk of about 12 cc/g or greater and a Compression Energy (E) from about 1.30 to about 2.00 N/m.

10. The tissue product of claim 9 having an Exponential Compression Modulus (K) from about 4.0 to about 6.0.

11. The tissue product of claim 9 having a basis weight from about 30 to about 45 gsm and a Vertical Absorbent Capacity from about 10 g/g to about 15 g/g.

12. The tissue product of claim 9 having a GMT from about 600 to about 1,000 g/3" and an Exponential Compression Modulus (K) less than about 6.50.

13. The tissue product of claim 9 comprising from about 30 to about 75 percent, by weight of the product, cross-linked hardwood kraft fibers.

14. The tissue product of claim 9 wherein the cross-linked cellulosic fibers comprise eucalyptus hardwood kraft fibers reacted with a cross-linking reagent selected from the group consisting of 1,3-dimethyl-4,5-dihydroxy-2-imidazolidinone (DMDHU), 1,3-dihydroxymethyl-4,5-dihydroxy-2-imidazolidinone (DMDHEU), bis[N-hydroxymethyl]urea (DMU), 4,5-dihydroxy-2-imidazolidinone (DHEU), 1,3-dihydroxymethyl-2-imidazolidinone(DMEU) and 4,5-dihydroxy-1,3-dimethyl-2-imidazolidinone (DMeDHEU).

15. The tissue product of claim 9 comprising a first fibrous layer cross-linked cellulosic fibers and a second fibrous layer that is substantially free from cross-linked cellulosic fibers.

* * * * *